United States Patent [19]

May

[11] 4,077,568

[45] Mar. 7, 1978

[54] MOBILE BOILER HOUSE

[75] Inventor: Richard May, Dadford, England

[73] Assignee: Intercity Electric & Mechanical Services Ltd., England

[21] Appl. No.: 694,649

[22] Filed: Jun. 10, 1976

[30] Foreign Application Priority Data

Jun. 18, 1975 United Kingdom ..... 25959/75

[51] Int. Cl.[2] ..... F24D 3/10; F27B 37/36

[52] U.S. Cl. ..... 237/8 D; 52/67; 52/71; 220/4 F; 296/26; 122/494

[58] Field of Search ..... 237/8 D, 9 R, 58, 59; 52/67, 71; 220/8, 4 F; 296/26; 122/494

[56] References Cited

U.S. PATENT DOCUMENTS

| | | | |
|---|---|---|---|
| 2,538,736 | 1/1951 | Spencer | 52/67 |
| 2,561,921 | 7/1951 | Guillot | 52/67 |
| 2,948,277 | 8/1960 | Dennis | 237/59 |
| 3,809,278 | 5/1974 | Csumrik | 220/4 F |
| 3,992,828 | 11/1976 | Ohe | 52/71 |

FOREIGN PATENT DOCUMENTS

| | | | |
|---|---|---|---|
| 1,139,741 | 7/1957 | France | 52/67 |

*Primary Examiner*—William F. O'Dea
*Assistant Examiner*—Henry C. Yuen
*Attorney, Agent, or Firm*—William Anthony Drucker

[57] ABSTRACT

The invention relates to a housing suitable for containing a boiler with its associated water tank and it consists of an upper part which for storage and transport can be telescoped over the lower part and when required for use can be raised to form an upper extension of the lower part and fixed in position. The lower part preferably carries pivoted flaps adapted to form an extension of the plan size of the lower part greater than the plan size of the upper part but which can be folded to enable the upper part to be telescoped down over the lower part.

3 Claims, 9 Drawing Figures

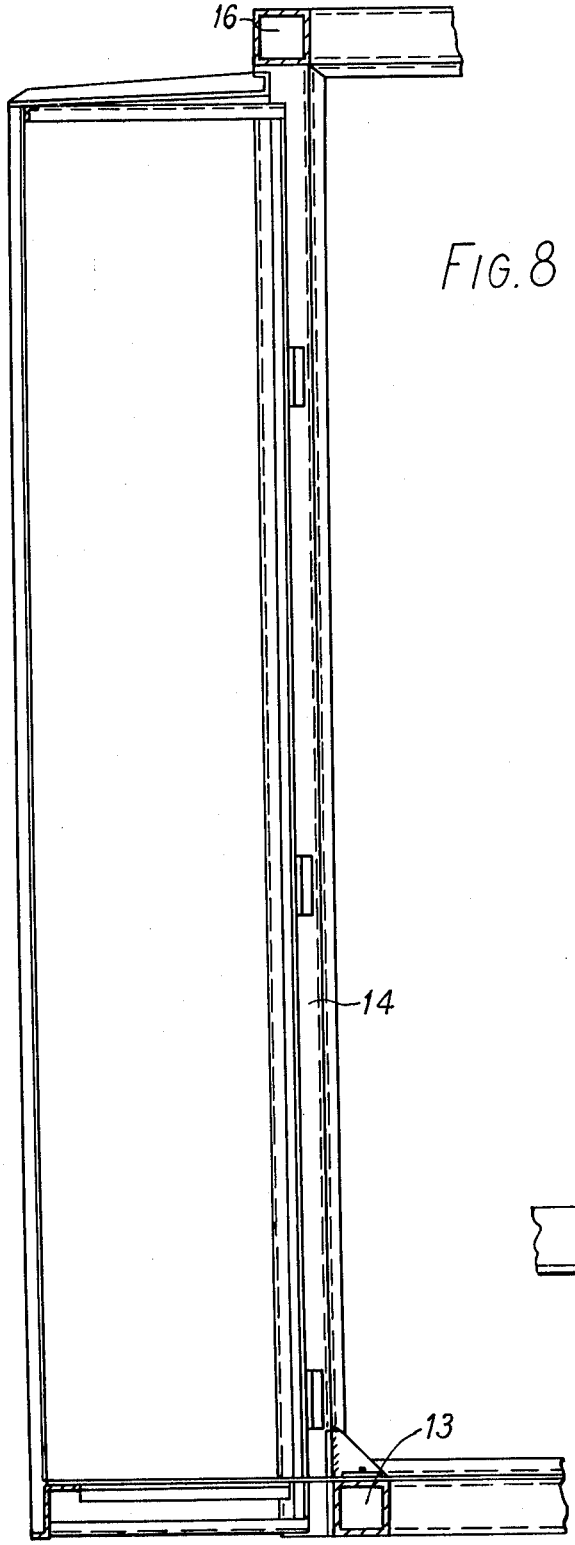
FIG. 8
FIG. 9
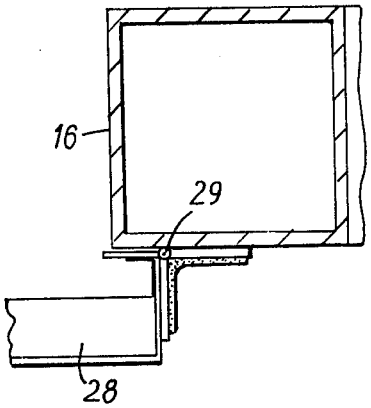

MOBILE BOILER HOUSE

This invention relates to transportable housings suitable for housing heating installations of the kind sometimes known as a mobile boiler house which consists of an oil or gas burner with ancillary pumps and controls which can be despatched to a building site as a unit more or less ready for use as soon as it is connected to the building site piping.

The main object of the invention is to provide a housing which can contain not only the boiler with its ancillary parts but also the necessary tanks (e.g. hot and cold water tanks) and which housing is convenient for transport.

According to the invention the housing is made in two box-like parts the lower part being adapted to contain a boiler and including a floor frame to carry the boiler, and at least some walls mounted on the floor frame, and an upper part adapted to contain a watertank for the boiler and having walls which can contain the lower part during storage and transport but which can be lifted to a position in which its lower edges are about level with the top edges of the lower part, means being provided for fixing the two parts together in that condition, said upper part having at least one removable wall member for insertion of the tank.

The lower part preferably has pivoted extension flaps which can be closed for transport so that the lower part including the flaps has a plan area just within that of the upper part and when the upper part is raised on site, the pivoted flaps can be opened out and additional panels fitted if required to complete the box-like construction.

The lower part may have a permanently fitted door.

The invention will now be further described, by way of example, with reference to the accompanying diagrammatic drawings wherein:

FIG. 8 is a vertical section showing a side flap; and

FIG. 9 is an end view of a flap 28 with a section of the frame 16 to which it is pivotally attached.

The housing consists of a lower part 10 to contain a boiler and an upper part 11 to contain a water tank to supply water to the boiler. The housing has a length greater than its width.

Figure 5:
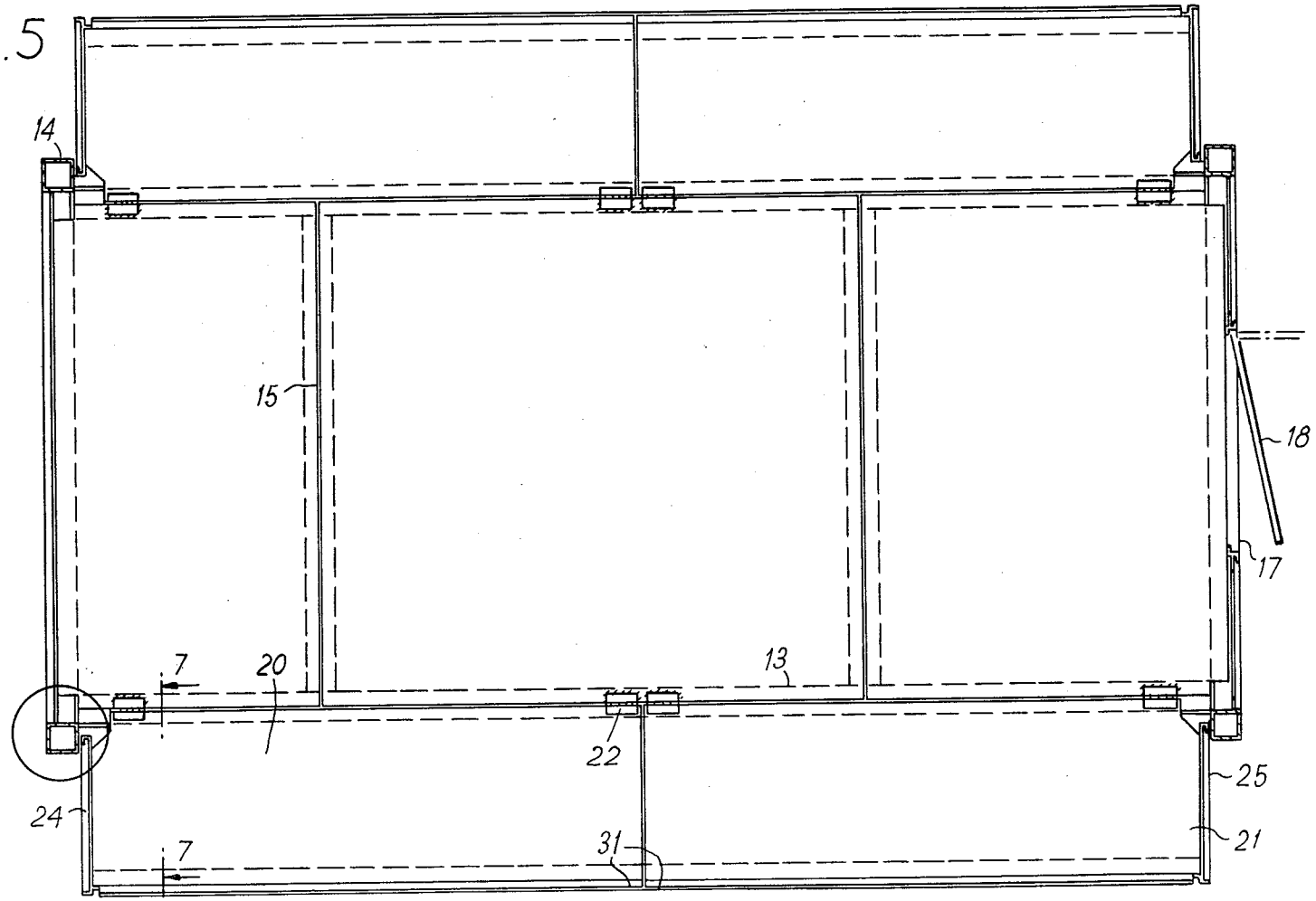
FIG. 5 is a plan view of the floor with floor and wall extension flaps.

The lower part has a strong steel base or floor frame consisting of a rectangle of angle or box sections 13 and cross-beams 15 (FIG. 5) welded to four box-section corner uprights 14. The upper ends of the uprights 14 are connected by a rectangular frame 16. One end of the lower part has a door frame 17 receiving a door 18.

Figure 1:
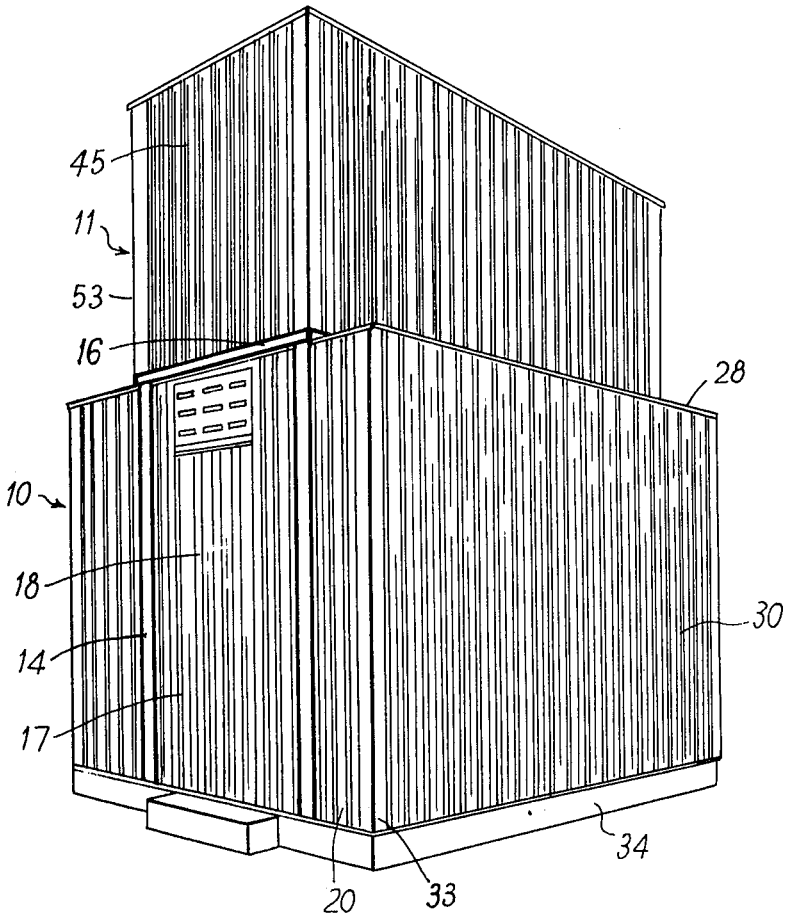
FIG. 1 is a perspective view of a housing made in accordance with the invention in erected condition intended as a boiler housing.
Figure 6:
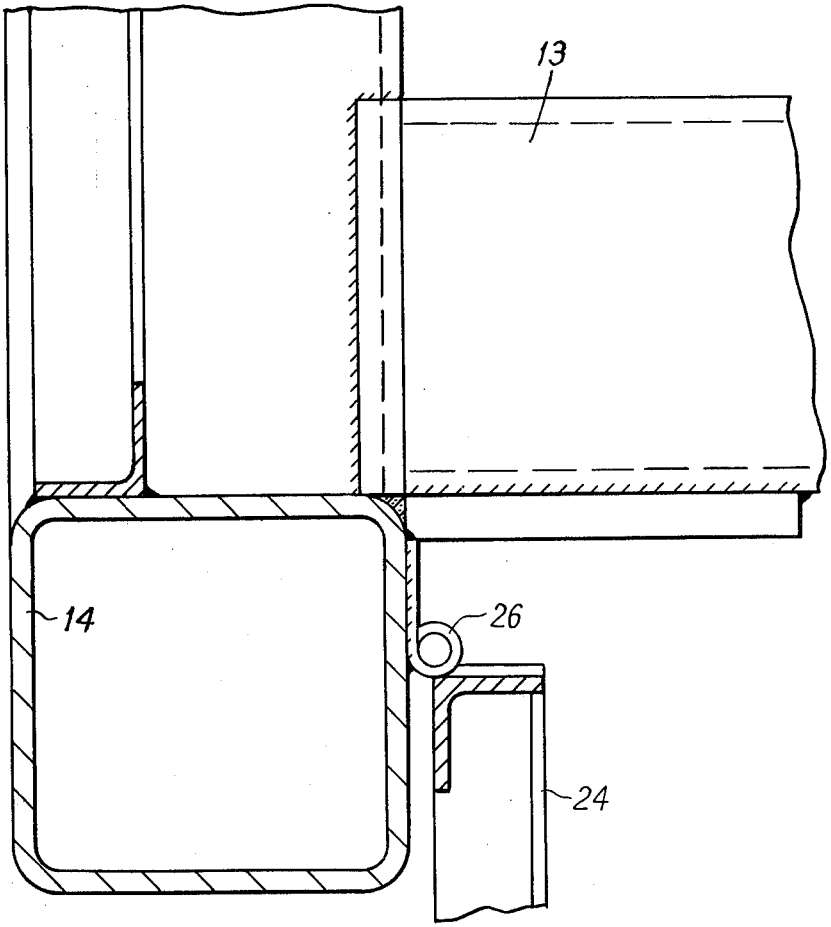
FIG. 6 is a detail on an enlarged scale of the part in the circle 6 on FIG. 5.
Figure 7:
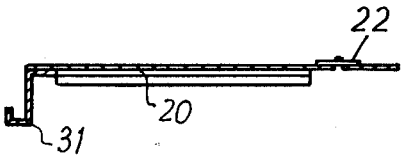
FIG. 7 is a section on the plane 7—7 on FIG. 5 through a floor extension flap.

Pivoted to each long side of the lower part are five flaps to form extensions of the lower part. Thus, two floor flaps 20, 21 are pivoted by hinges 22 to the floor frame 13, end vertical flaps 24, 25 are pivoted by hinges 26 (FIGS. 6 and 8) to the uprights 14, and a roof flap 28 is pivoted to the frame 16 by hinges 29 (FIG. 9). FIG. 9 is an end view of a flap 28 with a section of the frame 16 to which it is pivotally attached. When these flaps are opened out they form side extensions of the lower part 10 and are completed by loose side walls 30 (FIG. 1) which fit into channels 31 (FIGS. 5 and 7) attached to the outer edges of the flaps 20, 21. The roof flaps may carry channels similar to 31 to receive the upper edges of the walls 30. The walls 30 can be placed inside the floor and roof flaps for storage and transport.

When the flaps are closed they are located with the plan area of the lower part 10 i.e. within the area marked out by the uprights 14.

The corners of the extensions are covered by upright angle irons 33 (FIG. 1) which are attached by spring clips or screws.

Figure 4:
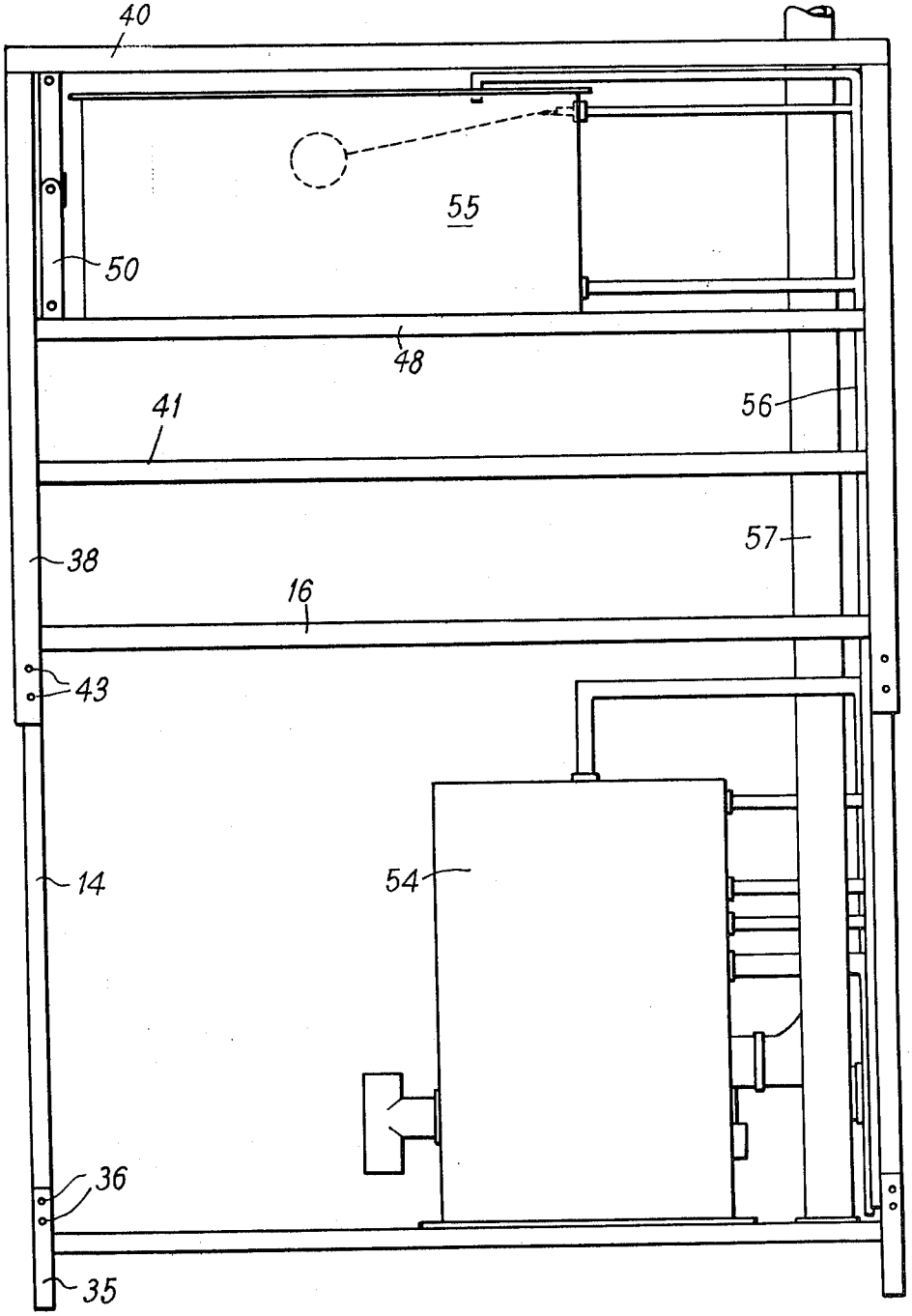
FIG. 4 is a side elevation of the framework in erected condition.

The lower part 10 seats on a concrete base 34 (FIG. 1) to which it may be anchored by strips 35 (FIG. 4) attached to the uprights 14 by bolts 36. The concrete base is not part of the transportable housing but is provided on site.

Figure 2:
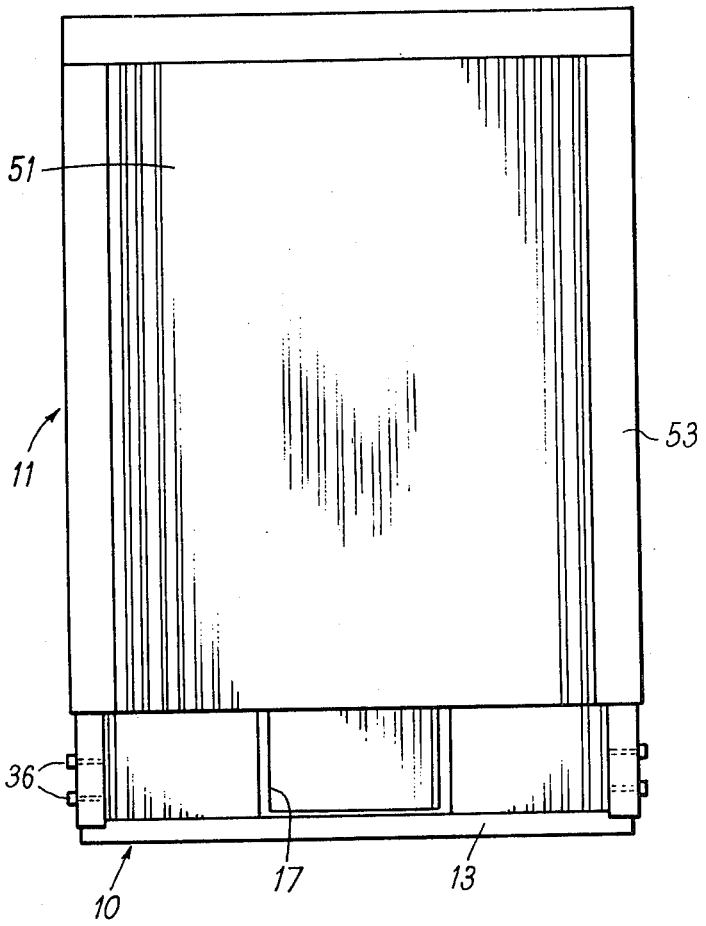
FIG. 2 is a front view in collapsed transportable condition.
Figure 3:
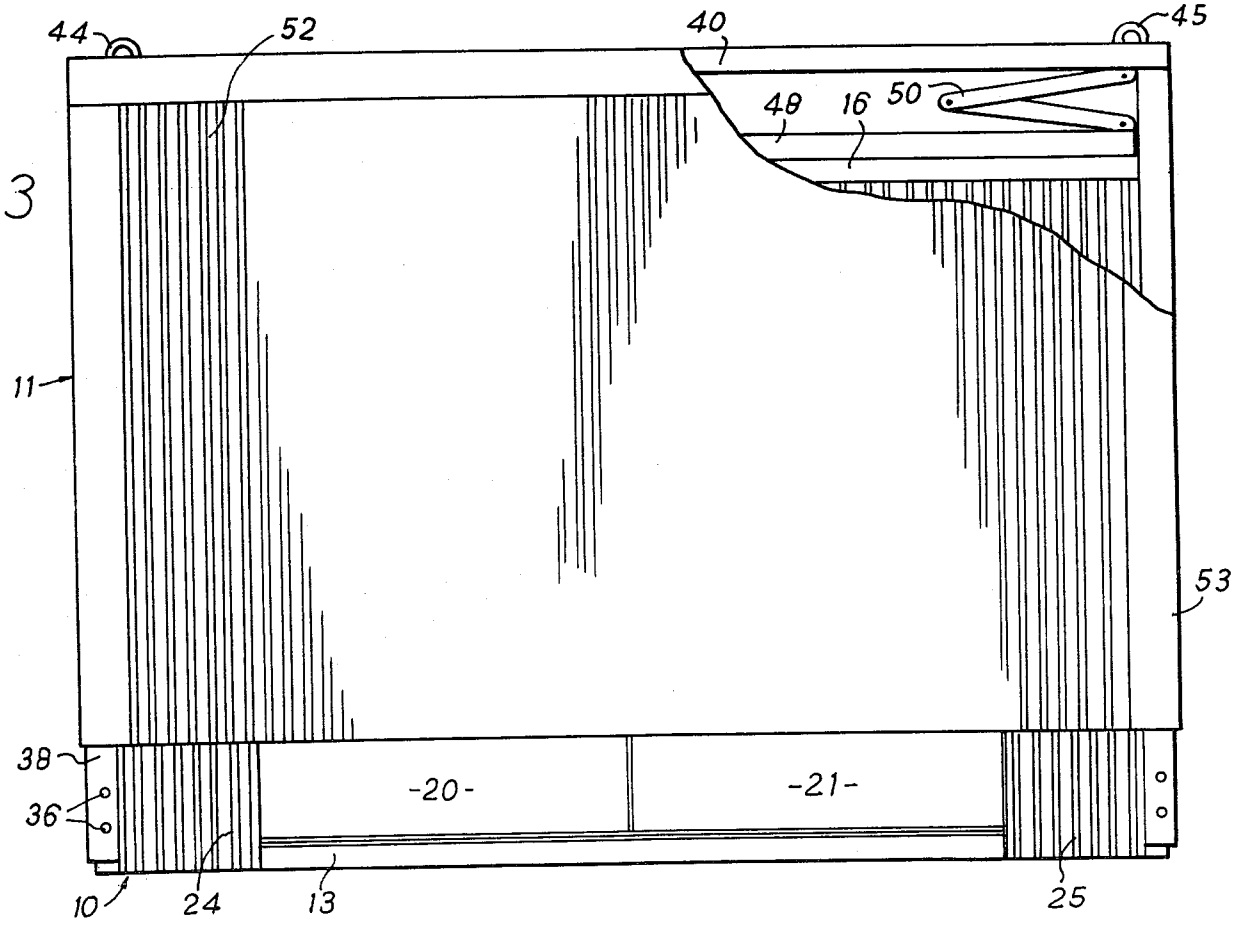
FIG. 3 is a side elevation in collapsed condition.

The upper part 11 of the housing consists of upright corner angle irons 38 connected together by various transverse members such as 40, 41 (FIG. 4) to form a box-like frame of such plan area that the angle irons can slide on and are guided by the outer surfaces of the uprights 14. Thus when the housing is collapsed for transport the upper part 11 encases nearly the whole of the lower part 10 and is fixed in lowered position by the bolts 36 as shown in FIGS. 2 and 3.

When the upper part is raised it is fixed in raised position by bolts 43 using the same bolts in the uprights 38.

When the upper part is raised its lower edges are about level with the top edges of the upper part.

The upper frame members 40 have lifting lugs 44, 45 attached to them.

The upper part 11 has a removable panel 45 for insertion of a water tank.

Inside the upper part is a horizontal frame 48 adapted to carry the water tank. This frame 48 is vertically movable to permit the upper part 11 to be collapsed down over the lower part 10. For this purpose the frame 48 is carried by four sets of linkage 50 the upper link of which is pivoted to the upper frame 40 and the lower link of which is pivoted to the frame 48.

All the frames are covered by corrugated metal sheets as 50 (FIG. 2) and 52 (FIG. 3) or other suitable sheet material. The covering may include corner angles for the upper part 11 such as 53.

When the housing is erected the boiler 54 (FIG. 4) is installed in the lower part 10 and the water tank 55 is installed in the upper part on the frame 48. All necessary piping 56 between the parts 10, 11 are arranged against the rear wall and a flue pipe 57 is provided nearby.

Suitable rubber packing or other water proofing may be provided at the hinges of the extension flaps or elsewhere as required.

I claim:

1. A water boiler and housing therefor comprising a lower housing part and an upper housing part, said lower housing part comprising a floor, corner uprights fixed to the floor, said upper housing part including upright corner angle irons which slide on and are guided by said corner uprights, horizontal side frame members connecting the adjacent corner uprights together at their upper ends, flaps pivoted to the floor, uprights and horizontal frame members adapted to be folded along the sides of the housing and to be opened out to form housing extensions on each side; said boiler being stationary supported by said floor within the lower housing part; said upper housing part including a roof and front, back and side walls adapted to slide telescopically and vertically over the lower housing part when said flaps are folded in, one of said walls having at least a part thereof removable for access, means for fixing the upper housing part to the lower housing part above the floor mounted flaps when said floor mounted flaps are in open extended positions, a horizontal support within the upper housing part adapted to support a water tank, vertically collapsible means connecting said support to the roof of the upper housing part whereby said support is near the roof when the upper housing part is collapsed over the lower housing part and is spaced further apart from the roof when the upper housing part is raised so as to provide a space between the roof and support to receive the water tank at the upper part of the upper housing part.

2. A water boiler and housing as claimed in claim 1 wherein said flaps on each side of said lower housing part consist of two floor flaps pivoted on a horizontal axis to the floor of the lower housing part, two side flaps pivoted on vertical axes to the front and rear uprights, a roof flap pivoted on a horizontal axis to horizontal side frame members of the upper housing part, loose side walls also being provided, said floor flaps having channels adapted to receive the bottom edges of said loose side walls.

3. A water boiler and housing as claimed in claim 1 wherein said vertically collapsible means consist of four sets of pivoted links at the corners of the upper housing part.

* * * * *